US006408525B1

(12) United States Patent
Marttiini

(10) Patent No.: US 6,408,525 B1
(45) Date of Patent: Jun. 25, 2002

(54) KNIFE

(75) Inventor: Lauri Marttiini, Rovaniemi (FI)

(73) Assignee: J. Marttiinin Puukkotehdas Oy, Rovaniemi (FI)

( * ) Notice: Subject to any disclaimer, the term of this patent is extended or adjusted under 35 U.S.C. 154(b) by 0 days.

(21) Appl. No.: 09/670,233

(22) Filed: Sep. 28, 2000

(30) Foreign Application Priority Data

Sep. 30, 1999 (FI) ..... 992109

(51) Int. Cl.[7] ..... B26B 3/00
(52) U.S. Cl. ..... 30/340
(58) Field of Search ..... 30/342, 340, 343, 30/344; 76/104.1, 105, 106

(56) References Cited

U.S. PATENT DOCUMENTS 630,675 A * 8/1899 Ferrall ..... 30/342
5,155,913 A * 10/1992 Marttiini ..... 30/342
5,210,925 A 5/1993 Morgulis

FOREIGN PATENT DOCUMENTS

| | | |
|---|---|---|
| DE | 4429063 | 2/1996 |
| FI | 87055 | 8/1992 |
| FR | 1156261 | 5/1958 |
| WO | 9942254 | 8/1999 |

* cited by examiner

*Primary Examiner*—Douglas D. Watts
(74) *Attorney, Agent, or Firm*—Ware, Fressola, Van Der Sluys & Adolphson LLP

(57) ABSTRACT

The invention relates to a knife comprising a blade with a blade tang at one end, a handle and an insert, which can be assembled by joining the insert and the blade tang, and when assembled, the insert and the blade tang are fitted into a hole in the handle having a cross-section substantially equal to the cross-section of the insert portion to be fitted within the handle. The invention is characterised in that at least part of the surface of the portion (6) of the insert (2) to be fitted within the handle (3) is a substantially non-smooth surface.

26 Claims, 2 Drawing Sheets

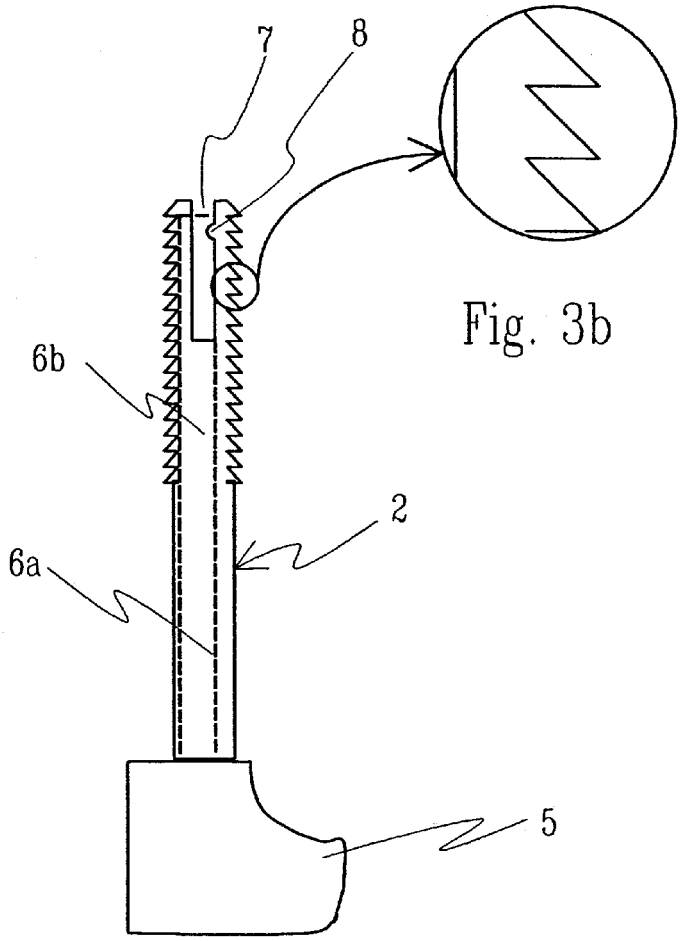
Fig. 3b
Fig. 3a
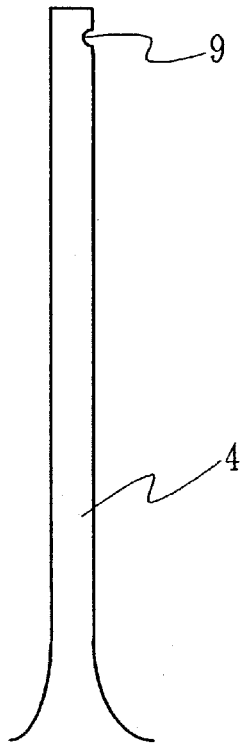
Fig. 3c
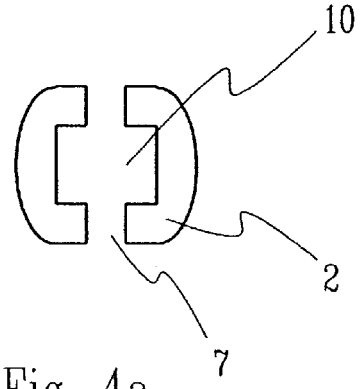
Fig. 4a
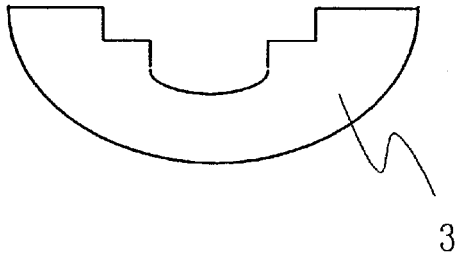
Fig 4b

KNIFE

TECHNICAL FIELD

The invention relates to a knife comprising a blade with a blade tang at one end, a handle and an insert, which can be assembled by joining the insert and the tang, and when assembled, the insert and the tang are fitted into a hole in the handle having a cross-section substantially equal to the cross-section of the insert portion to be fitted within the handle.

BACKGROUND OF THE INVENTION

The manufacture of a knife usually comprises fitting of the blade tang into a hole in the centre of the handle and fastening of one end of the tang by riveting. This manufacturing method calls for a great number of manual operations. On the other hand, FI patent specification 87055 discloses a knife whose parts are assembled by gluing. Gluing has the major advantage of allowing automatised manufacture of the knife, which results in reduced production costs.

However, glued joints tend to dry, whereby the knife falls apart. Especially the operating conditions have a bearing on the durability of the glue; for instance, a number of glues have no cold resistance (at summer cottages, in boats, etc.). It may also be difficult to find a suitable glue when the different parts of the knife are made of different materials, for instance, the handle is made of wood, the blade of metal and the insert of plastic. Glue application also calls for complex machinery. On top of that, gluing frequently causes various gas and odour emissions to the working premises, such emissions being unpleasant in the working environment and perhaps even involving a health hazard.

SUMMARY OF THE INVENTION

Thus the object of the invention is to provide a knife that has a long and reliable service life under various circumstances and which is easy and rapid to manufacture without any risks for the working environment. These objects are achieved with the knife in accordance with the invention such as defined in the accompanying claims.

The invention thus relates to a knife comprising a blade with a blade tang at one end, a handle and an insert. The characterising feature of the knife in accordance with the invention is that at least part of the outer surface of the insert portion fitted within the handle is substantially a non-smooth surface. Said non-smooth surface is preferably a fluted surface.

Consequently, the assembly of the knife of the invention does not require any glue or rivets, the retention of the tang within the handle being ensured by means of the fluted insert surface. In this manner, the knife will have a service life of several years regardless of its operating conditions. The material creep will be so insignificant that it has no practical impact in this case.

In one embodiment of the invention, the walls in the grooves of said fluted surface are at a substantially different angle of inclination to the normal of the surface, and preferably the first groove wall adjacent to the blade is at a specific angle to the normal of the surface, and the second groove wall remote from the blade is substantially parallel with the normal of the surface. Such a groove design further enhances the retention of the tang within the handle.

In a further embodiment of the invention at least part of the insert portion fitted within the handle comprises a groove extending longitudinally through said insert. Preferably, the outer groove end viewed from the blade converges with the outer insert end viewed from the blade. By way of example, said groove length accounts for 30 to 100%, preferably 50 to 100%, most preferably for 80 to 100% of the length of the insert portion fitted within the handle.

In a preferred embodiment of the invention, an especially durable joint is provided when

- the first inner wall of said groove comprises a projection,
- the second inner wall of said groove is substantially plane, and
- the blade tang comprises a notch having a shape substantially matching the projection of the first inner wall of the groove, so that said projection engages said notch with the insert and the blade tang assembled. Such a pair of projection-notch prevents any disengagement of the tang from the insert, for instance when the blade is being pulled at.

In a further embodiment of the invention at least the first portion of the surface of the insert portion fitted within the handle comprises two substantially parallel, substantially planar surfaces, and two mutually symmetric surfaces which are convex relative to the insert centre and connect said two surfaces. Then the first portion of the outer surface of the insert has a length that accounts for 30 to 100%, preferably 50 to 100%, most preferably 80 to 100% of the length of the insert portion fitted within the handle. In addition, said convex surfaces are preferably fluted and said preferably planar surfaces are preferably smooth.

The different parts of the knife of the invention can be manufactured of any material desired, such as for instance plastic, metal, wood, stone or a combination of at least two of these.

The insert of the knife of the invention may further be integrated with the ferrule member or not, or the insert may comprise a plurality of discrete parts.

BRIEF DESCRIPTION OF THE DRAWINGS

The invention is described in further detail below with reference to the accompanying drawings, in which FIG. 3*a* shows the insert of the knife of a second embodiment of the invention, FIG. 3*b* is a partial enlargement of FIG. 3*a,*

FIG. 3*c* shows the blade tang of the knife of a second embodiment of the invention, FIG. 4*a* is a cross-section AA of FIG. 2, and FIG. 4*b* is a cross-section BB of FIG. 2.

FIG. 1 shows a knife comprising a blade 1, an insert 2 and a handle 3.

BEST MODE FOR CARRYING OUT THE INVENTION

Figure 2:
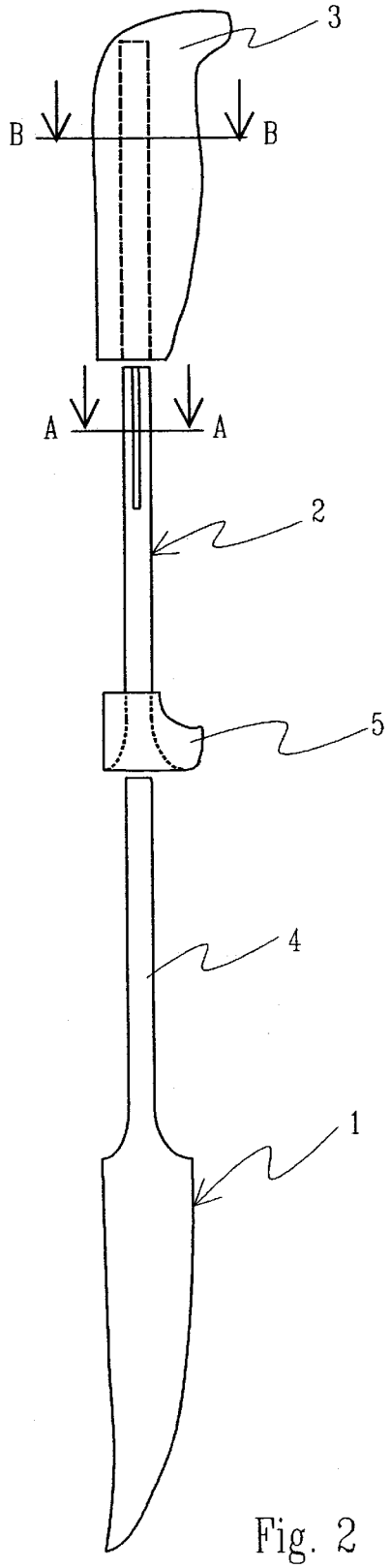
FIG. 2 is an exploded view of the knife of the first embodiment of the invention.

FIG. 2 is an exploded view of the knife of the first embodiment of the invention. The knife comprises a blade 1, a blade tang 4 and an insert 2, which also comprises a tang-like elongated portion. In the ferrule member 5 of the insert 2, the insertion of the blade 1 into the insert 2 is shown with broken lines. The figure also shows the knife handle 3 and the insertion of the insert 2 into the handle 3 with broken lines. The figure also shows the cross-sections AA and BB illustrated in FIGS. 4*a* and 4*b*.

FIG. 3*a* shows the insert of the knife of a second embodiment of the invention. The elongated portion 6 of the insert 2 comprises two members 6*a* and 6*b*. The member 6*a* has smooth surfaces and in cross-section it comprises two parallel straight lines with curves joining the straight lines at both ends. The cross-section of the member 6*b* is similar, however, with the curved parts fluted as shown in the figure. The fluting is illustrated also in FIG. 3*b*, which is a partial enlargement of FIG. 3*a*. The figure also shows a groove 7 and a projection 8 made in the groove 7. FIG. 3*a* further shows with broken lines how the tang 4 of the blade 1 of FIG. 3*c* is inserted into the portion 6.

FIG. 3*c*, in turn, shows the tang 4 of the knife blade 1 of a second embodiment of the invention, the tang comprising a notch 9 matching substantially the projection 8 in shape. The notch 9 is positioned such that with the tang 4 of the blade 1 fitted into position within the insert 2, the projection 8 engages the notch 9.

FIG. 4*a* shows a cross-section AA of FIG. 2. The figure thus shows the elongated portion 6 of the insert 2 in cross-section, comprising a groove 7. With the knife assembled, the space 10 will receive the tang 4 of the knife blade 1. However, part of the elongated portion 6 of the insert 2 may be e.g. circular in cross-section.

FIG. 4*b* shows a cross-section BB of FIG. 2. The figure thus shows the knife handle 3 in cross-section. The notch made in the knife handle 3 for the insert 2 and the tang 4 of the blade 1 is preferably graded as in the figure rather than circular. The cross-section of the insert can then be that of FIG. 4*a*, because an insert of this type is easier to manufacture than a circular insert.

What is claimed is:

1. A knife comprising a blade with a blade tang at one end, a handle and an insert, which can be assembled by joining the insert and the blade tang, and when assembled, the insert and the blade tang are fitted into a hole in the handle, the hole in the handle having a cross-section substantially equal to the cross-section of the insert portion to be fitted within the handle, characterised in that:

at least part of the portion (6) of the outer surface of the insert (2) to be fitted within the handle (3) is substantially a non-smooth surface, wherein substantially all of the non-smooth surface contacts the handle.

2. A knife according to claim 1, characterised in that said non-smooth surface is a fluted surface.

3. A knife according to claim 2, characterised in that the walls of the grooves of said fluted surface are at substantially different angles of inclination to the normal to the surface.

4. A knife according to claim 3, characterised in that at least part of the portion (6) of the insert (2) to be fitted within the handle (3) comprises a groove (7) extending longitudinally through said insert (2).

5. A knife according to claim 4, characterised in that the outer end of said groove (7) viewed from the blade (1) converges with the outer end of the insert (2) viewed from the blade (1).

6. A knife according to claim 5, characterised in that the length of said groove (7) accounts for 30 to 100% of the length of the portion (6) of the insert (2) to be fitted within the handle (3).

7. A knife according to claim 6, characterised in that the first inner wall of said groove (7) comprises a projection (8), the second inner wall of said groove (7) is substantially plane, and the tang (4) of the blade (1) comprises a notch (9) substantially matching the projection (8) in the first inner wall of the groove (7) so that said projection (8) engages said notch (9) with the insert (2) and the tang (4) of the blade (1) being assembled.

8. A knife according to claim 1, characterised in that at least a first part of the surface of the portion (6) of the insert (2) to be fitted within the handle (3) comprises two substantially parallel, substantially planar surfaces, and two mutually symmetrical surfaces which connect said two surfaces and are convex relative to the centre of the insert (2).

9. A knife according to claim 8, characterised in that the first part of the surface of the portion (6) of the insert (2) has a length that accounts for 30 to 100% of the length of the portion (6) of the insert (2) to be fitted within the handle (3).

10. A knife according to claim 9, characterised in that said convex surfaces are fluted and said substantially planar surfaces are smooth.

11. A knife according to claim 1, characterised in that the insert (2) is made of plastic or metal.

12. A knife according to claim 1, characterised in that the handle (3) is made of wood, plastic, metal or stone.

13. A knife according to claim 1, characterised in that the insert (2) and the ferrule part (5) are discrete components.

14. A knife according to claim 1, characterised in that the insert (2) is made in one piece with the ferrule part (5).

15. A knife according to claim 1, characterised in that the insert (2) comprises at least three discrete parts.

16. A knife according to claim 1, characterised in that at least part of the portion (6) of the insert (2) to be fitted within the handle (3) comprises a groove (7) extending longitudinally through said insert (2).

17. A knife according to claim 16, characterised in that the outer end of said groove (7) viewed from the blade (1) converges with the outer end of the insert (2) viewed from the blade (1).

18. A knife according to claim 17, characterised in that the length of said groove (7) accounts for 30 to 100% of the length of the portion (6) of the insert (2) to be fitted within the handle (3).

19. A knife according to claim 18, characterised in that the first inner wall of said groove (7) comprises a projection (8), the second inner wall of said groove (7) is substantially plane, and the tang (4) of the blade (1) comprises a notch (9) substantially matching the projection (8) in the first inner wall of the groove (7) so that said projection (8) engages said notch (9) with the insert (2) and the tang (4) of the blade (1) being assembled.

20. A knife according to claim 4, characterised in that the length of said groove (7) accounts for 30 to 100% of the length of the portion (6) of the insert (2) to be fitted within the handle (3).

21. A knife according to claim 4, characterised in that the first inner wall of said groove (7) comprises a projection (8), the second inner wall of said groove (7) is substantially plane, and the tang (4) of the blade (1) comprises a notch (9) substantially matching the projection (8) in the first inner wall of the groove (7) so that said projection (8) engages said notch (9) with the insert (2) and the tang (4) of the blade (1) being assembled.

22. A knife according to claim 6, characterised in that the length of said groove (7) accounts for 80 to 100% of the length of the portion (6) of the insert (2) to be fitted within the handle (3).

23. A knife according to claim 9, characterised in that the first part of the surface of the portion (6) of the insert (2) has a length that accounts for 80 to 100% of the length of the portion (6) of the insert (2) to be fitted within the handle (3).

24. A knife according to claim 18, characterised in that the length of said groove (7) accounts for 30 to 100% of the length of the portion (6) of the insert (2) to be fitted within the handle (3).

25. A knife according to claim 20, characterised in that the length of said groove (7) accounts for 30 to 100% of the length of the portion (6) of the insert (2) to be fitted within the handle (3).

26. A knife according to claim 3, characterised in that the walls of the grooves of said fluted surface are at substantially different angles of inclination to the normal of the surface, the first wall of the groove adjacent to the blade (1) being at a specific angle to the normal to the surface and the second wall of the groove remote from the blade (1) being substantially parallel with the normal to the surface.

* * * * *

UNITED STATES PATENT AND TRADEMARK OFFICE

CERTIFICATE OF CORRECTION

PATENT NO. : 6,408,525 B1
DATED : June 25, 2002
INVENTOR(S) : L. Marttiini

Figure 1:
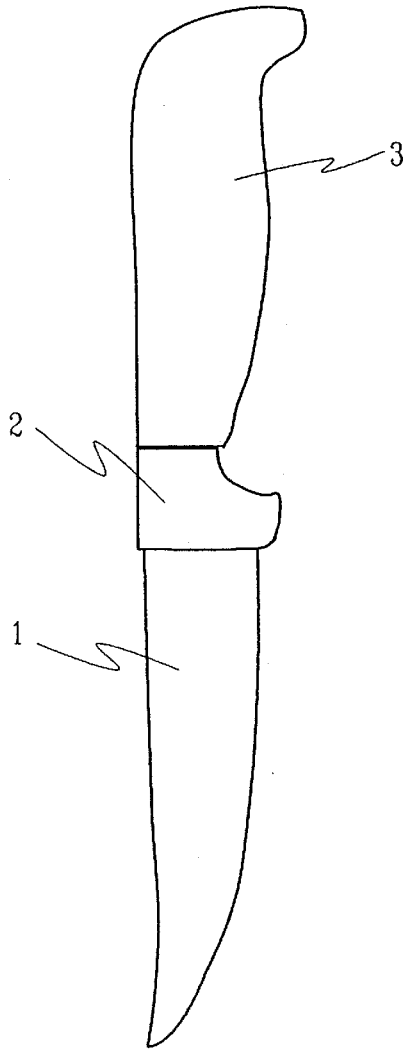
FIG. 1 shows a knife.

It is certified that error appears in the above-identified patent and that said Letters Patent is hereby corrected as shown below:

Column 2,
Lines 55 and 56, "BEST MODE FOR CARRYING OUT THE INVENTION" should be moved to the space before line 51 beginning "FIG. 1."

Signed and Sealed this

Eleventh Day of February, 2003

JAMES E. ROGAN
*Director of the United States Patent and Trademark Office*